US005224419A

United States Patent [19]

Fukai

[11] Patent Number: 5,224,419

[45] Date of Patent: Jul. 6, 1993

[54] STENCIL MASTER PLATE MAKING PRINTING DEVICE

[75] Inventor: Shigeki Fukai, Tokyo, Japan

[73] Assignee: Riso Kagaku Corporation, Tokyo, Japan

[21] Appl. No.: 894,432

[22] Filed: Jun. 5, 1992

[30] Foreign Application Priority Data

Jun. 7, 1991 [JP] Japan ..... 3-136789
Jun. 7, 1991 [JP] Japan ..... 3-136842

[51] Int. Cl.[5] ..... B41C 1/14

[52] U.S. Cl. ..... 101/128.4; 101/116; 358/296

[58] Field of Search ..... 101/128.4, 129, 116-120, 101/128.1; 358/296; 395/102

[56] References Cited

U.S. PATENT DOCUMENTS 4,628,813 12/1986 Hasegawa et al. ..... 101/128.4
4,718,340 1/1988 Love, III ..... 101/116
4,903,595 2/1990 Ericsson ..... 101/128.4
4,957,378 9/1990 Shima ..... 101/128.4
5,140,898 8/1992 Igarashi ..... 101/120

*Primary Examiner*—Eugene H. Eickholt
*Attorney, Agent, or Firm*—Dickstein, Shapiro & Morin

[57] ABSTRACT

In a stencil master plate making printing device which can lay out duplicated images on printing paper on either side of a central line thereof without regard to the size of the originals or the printing paper that is used so that each sheet of the printed paper may be easily cut apart into a plurality of parts each serving as a desired printed copy or so that two-sided printed leaves may be obtained by folding each sheet of the printed paper along the central line and binding them together. This can be accomplished by appropriately controlling the feeding of a stencil master plate according to the size of the original images and the size of the paper on which the original images are to be reproduced in a plurality of frames.

4 Claims, 8 Drawing Sheets

STENCIL MASTER PLATE MAKING PRINTING DEVICE

TECHNICAL FIELD

The present invention relates to a stencil master plate making printing device which allows a plurality of original images to be laid out on a printed copy by laying out the original images on a stencil master plate in an appropriate manner.

BACKGROUND OF THE INVENTION

According to a conventional stencil plate making printing machine, a stencil master plate is processed by a plate making printing unit consisting of a thermal head and a platen roller according to an original image signal obtained by a plate making reading unit, and the processed stencil master plate is wrapped around a printing drum. To obtain a printed copy, the ink which has been pushed out from the printing drum and passed through the perforations corresponding to a desired picture image is transferred onto printing paper.

In such stencil master plate printing devices, it is sometimes required to have a function of so-called multiple frame copying which allows picture images of, for instance, two B5 sized originals to be written into a duplication medium having a B4 sized printing region, side by side.

Such a multiple frame printing function can be accomplished according to the following control process.

First of all, after a multiple frame printing key is pressed, a first original which is to be copied as part of the multiple frame printing process is read at a plate making reading unit and the image of this original is written into a stencil master plate in a plate making printing unit consisting of a thermal head and a platen roller. When it is detected that the reading of the first original at the plate making reading unit is completed, the rotation of the platen roller is stopped, and the writing process by the thermal head is temporarily interrupted.

When reading of a second original is started, the printing process by the thermal head is started so that a stencil master plate may be processed with the originals allocated to a plurality of frames, and the stencil master plate is then wrapped around a drum to start the process of printing.

BRIEF SUMMARY OF THE INVENTION

When a multiple frame printing function of such a conventional stencil master plate making printing device is employed, for instance, to copy two B5 sized originals placed one next to the other onto printing paper having an A3 sized original image printing region by using an A3 sized stencil master plate, the copied images of the B5 sized originals are offset to the left on the A3 sized printing paper.

In other words, the second B5 sized original is copied onto the A3 sized printing paper across a central line thereof, and some inconveniences arise because the A3 sized printing paper cannot be cut apart at the central line for useful purpose, and because the A3 sized printing paper cannot be folded at its center for using it as a two-sided single leaf in its bound state.

The present invention was made in view of such problems of the prior art, and a primary object of the present invention is to provide an stencil master plate printing device which can lay out duplicated images on a printing paper on either side of a central line thereof without regard to the size of the originals or the printing paper that is used.

A second object of the present invention is to provide a stencil master plate making printing device which allows printed copies to be folded at a central line thereof so as to provide two-sided printed leaves in their bound condition.

These and other objects of the present invention can be accomplished by providing stencil master plate printing device, comprising: multiple frame printing mode set up means for setting up a mode for writing a plurality of original images optically read by an original reading unit into different frames defined in a stencil master plate with an original image writing unit; printing paper size detection means for detecting the size of printing paper; writing amount data storage means for storing writing amount data for evenly distributing said frames defined in an original image printing region in said stencil master plate according to said size of said printing paper; and control means for laying out said original images obtained from said original reading unit into said original image printing region corresponding to said size of said printing paper by referring to data retrieved from said writing amount data storage means according to a detection value from said printing paper size detection means when said multiple frame printing mode is set up by said multiple frame printing mode set up means.

Alternatively, the size of the printing paper may be entered externally instead of detecting it with a paper size sensor or the like.

According to the present invention, once a plurality of printing frames are defined on a printing paper by the multiple frame printing mode set up means, the control means controls the device so as to evenly lay out the original images into the original image printing region corresponding to the detected size of the printing paper by referring to data retrieved from the printing amount data storage means according to a detection value from the printing paper size detection means or a value entered from paper size input means. Therefore, the images to be duplicated are evenly laid out so that each image may fall into one of the frames defined in the printing region without regard to the size of the printing paper that is used for printing images in a plurality of frames.

Preferably, the frames are distributed on either side of a central line of the printing paper without crossing the central line so that each sheet of the printed paper may be easily cut apart into a plurality of parts each serving as a desired printed copy or so that two-sided printed leaves may be obtained by folding each sheet of the printed paper along the central line and binding them together.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1A:
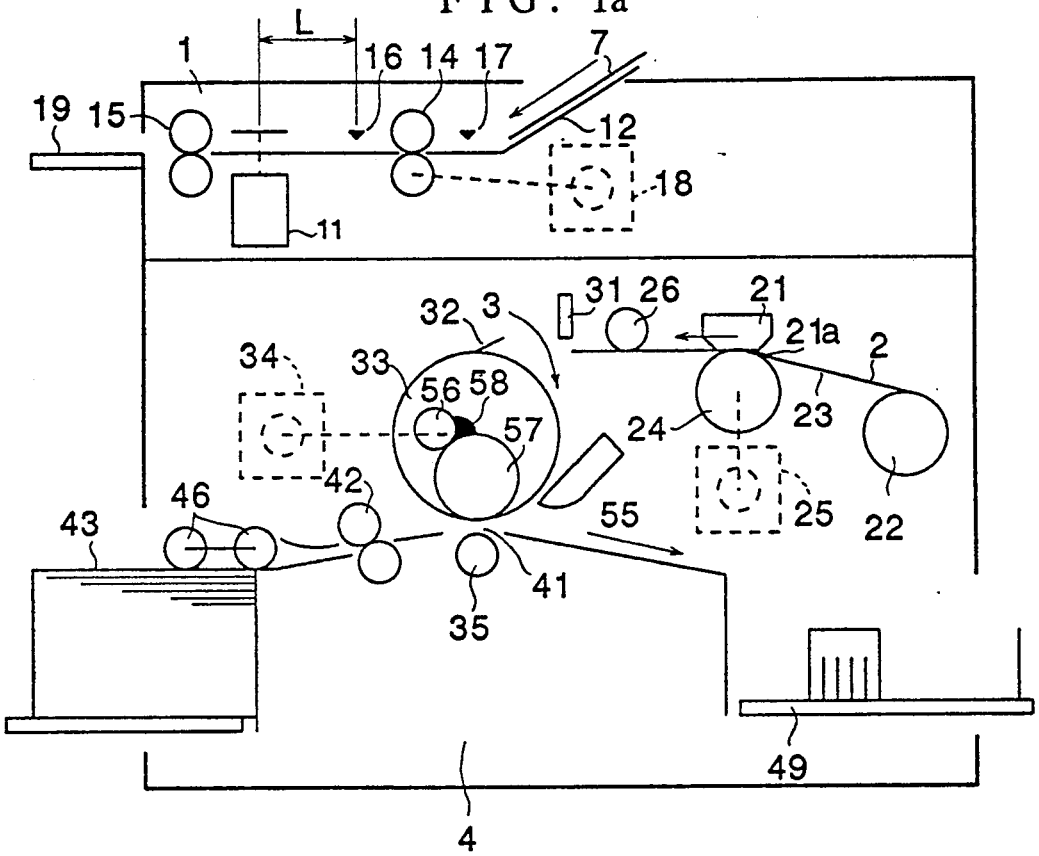
FIGS. 1*a* and 1*b* are a sectional side view and a plan view, respectively, of a first embodiment of the stencil master plate printing device according to the present invention.

FIG. 1*a* is a sectional side view showing an example of the stencil master plate printing device according to the present invention which is applied to a stencil plate making printing machine, and this stencil master plate printing device comprises a plate making reading unit 1 for reading an original, a plate making printing unit 2 for printing an image of the original into a stencil master plate, a cutter unit 3, and a printer unit 4 for reproducing the image on paper.

The plate making reading unit 1 comprises an original set-up table 12 for setting up an original 7 which is to be duplicated thereon, an original sensor 17 for detecting the presence of an original 7 set up on the original set-up table 12, a pair of original feed rollers 14 which are rotatively driven according to a detection signal from the original sensor 17, a contact type image sensor 11 for converting the image of the original 7 conveyed thereto into an electric signal, and a pair of original ejection rollers 15 for ejecting the original 7 read by the image sensor 11 onto an original ejection tray 19.

An original IN sensor 16 detects the arrival of an original 7, and determines the timing for starting the plate making printing unit 2.

The original feed rollers 14 and the original ejection rollers 15 are rotatively driven by a stepping motor 18 as indicated by the dotted lines in the drawing.

The plate making printing unit 2 comprises a thermal head 21 consisting of a plurality of heater elements 21*a*, a platen roller 24 for pressing a stencil master plate 23 fed from a stencil master plate roll 22 against the thermal head 21, and a pair of master plate feed rollers 26 for feeding the stencil master plate 23 processed by the thermal head 21 to a clamping unit 32 of a printing drum 33 which is described hereinafter.

A printing motor 25 which is indicated by the dotted lines is a stepping motor which rotatively drives the platen roller 24 and the master plate feed rollers 26.

The cutter unit 3 is provided with a cutter 31 which cuts off the stencil master plate 23 when the stencil master plate 23 processed by the thermal head 21 is wrapped around the drum 33 by a prescribed length.

The printer unit 4 comprises the printing drum 33 incorporated with an ink supply unit for supplying a prescribed amount of printing ink to the inner surface of the printing drum 33 through an ink reservoir 58 formed between a doctor roller 56 and a squeegee roller 57, pick up rollers 46 for picking up and feeding printing paper 43 on which the image is to be reproduced from a paper feed table 44 sheet by sheet, timing rollers 42 for feeding out the printing paper 43 supplied from the pick up rollers 46, a press roller 35 for pressing the printing paper 43 supplied from the timing rollers 42 against the external surface of the printing drum 33, a separation claw 55 for peeling off the printed printing paper from the drum 33, and a paper ejection table 49 for stacking the printing paper 43 peeled off and ejected from the drum 33.

The external surface of the drum 33 is provided with a clamping unit 32 for clamping the leading edge of the master plate 23 processed by the thermal head 21 and fed thereto, and the processed stencil master plate 23 is wrapped around the outer circumferential surface of the drum 33 by turning the drum 33 after clamping the leading edge of the stencil master plate 23 thereto.

A main motor 34 which is indicated by the dotted lines in the drawing is a DC motor for rotatively driving the drum 33. Numeral 41 denotes a conveying path.

Figure 1B:
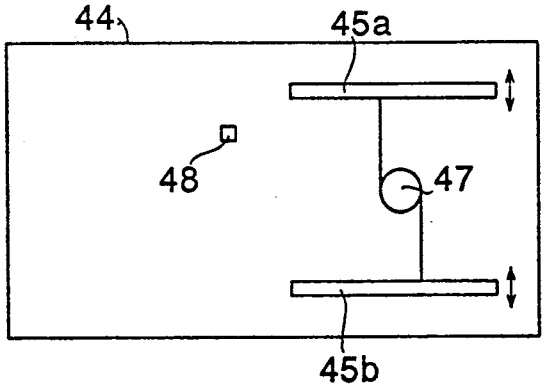

FIG. 1*b* is a plan view of the paper feed table 44 as seen from above, and this paper feed table 44 is provided with right and left fences 45*a* and 45*b* which are moveable to determine the area from which the printing paper 43 is to be supplied. The right and left fences 45*a* and 45*b* are provided with printing paper size detecting means 47 which may consist of a potentiometer for determining the size of the printing paper 43 according to the displacement of these fences.

The paper feed table 44 is further provided with paper sensor 48 for detecting the orientation of the printing paper 43 on the paper feed table 44, namely, landscape or portrait.

Figure 2:
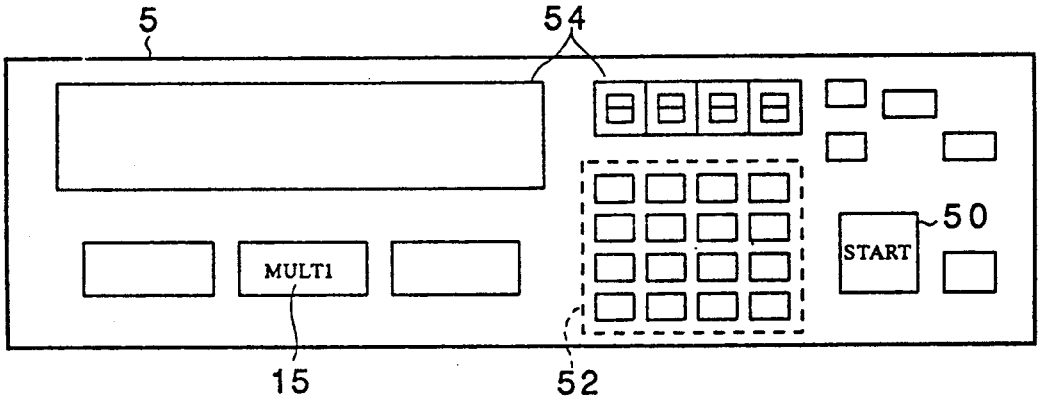
FIG. 2 is a front view showing the operation panel of the stencil master plate making printing machine shown in FIG. 1.

FIG. 2 shows the operating panel for the stencil master plate printing machine constructed as described above, and this operating panel 5 comprises a start key 50 for starting the process of plate making or printing, a multiple frame printing key 51 for setting up a multiple frame printing mode or, in other words, multiple frame printing mode set up means for printing a plurality of original images optically scanned at the plate making reading unit 1 individually into a plurality of frames defined in the printing paper 43 at the plate making printing unit 2, a ten-key pad 52 for entering the number of copies to be printed and other numerical information, and a display device 54 such as an LCD for indicating the number of copies to be printed entered from the ten-key pad 52, the selection of the multiple frame print mode by the pressing of the multiple frame printing key, and other information.

Figure 3:
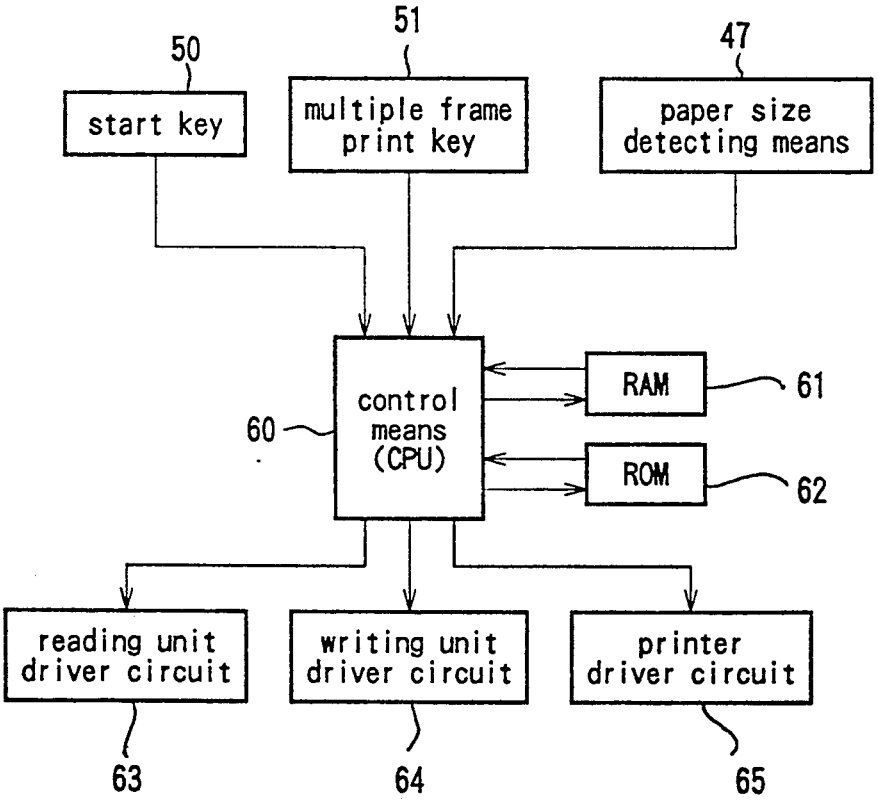
FIG. 3 is a control block diagram of the stencil master plate making printing machine shown in FIG. 1.

FIG. 3 is a control block diagram of the stencil plate making printing device which is constructed as described above, and numeral 60 in this drawing denotes control means equipped with a CPU for controlling the overall operation of the machine.

Numeral 61 denotes storage means consisting of RAM for storing data on the number of copies, the multiple frame printing mode, and other information entered from the operating panel.

Figure 4:
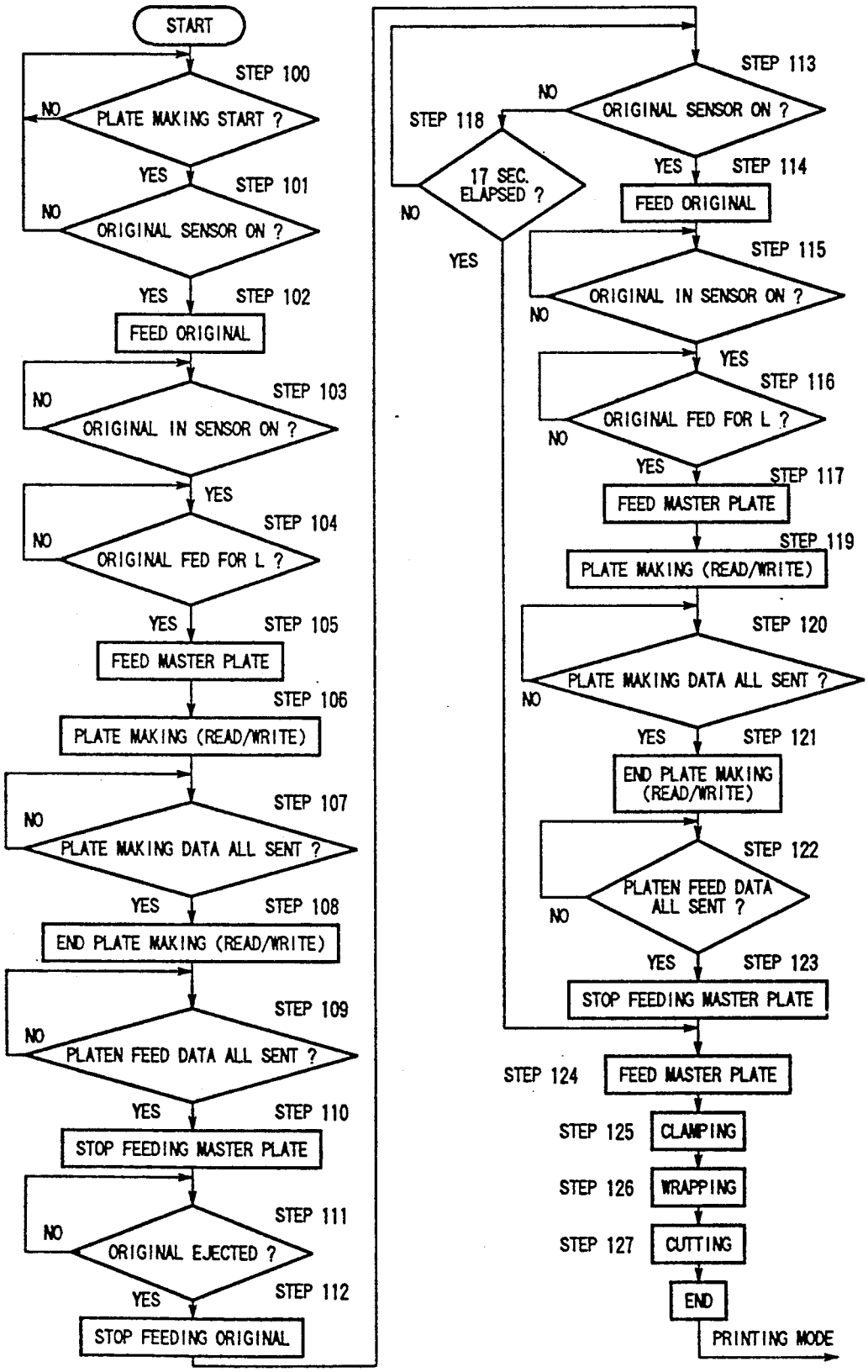
FIG. 4 is a flow chart showing the operation of the stencil master plate making printing machine shown in FIG. 1.

Numeral 62 denotes ROM serving as printing amount data storage means or plate making amount data storage means which stores such information as the data on the feed stroke of the platen roller 24 for each stencil master plate 23, the data on the amount of plate making for forming master plate images onto the evenly defined frames or regions in the printing paper according to its size in executing the multiple frame printing mode, the data on the feed stroke of the platen roller related to the execution of the multiple frame printing mode, as well as the program for executing the steps shown in FIG. 4.

Numeral 47 denotes printing paper size detecting means for producing a signal corresponding to the size of the printing paper 43 placed on the paper feed table 44, numeral 63 denotes a plate making reading unit driver circuit for driving the plate making reading unit 1, numeral 64 denotes a plate making printing unit driver circuit for driving the plate making printing unit 2, and numeral 65 denotes a printer unit driver circuit for driving the printer unit 4.

Now the operation of the stencil plate making printing machine constructed as described above is described in the following with reference to the flow chart given in FIG. 4.

Figure 5A:
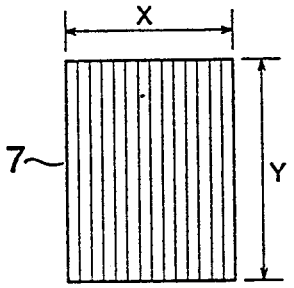
FIGS. 5*a* through d are diagrams showing the principle of the function of the repeated duplication by the stencil master plate making printing machine shown in FIG. 1.
Figure 5B:
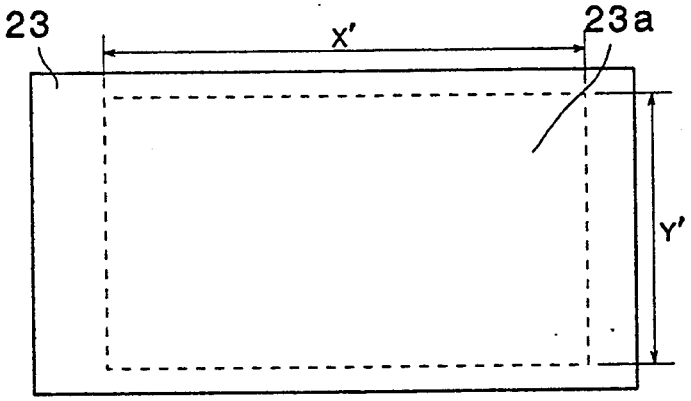
Figure 5C:
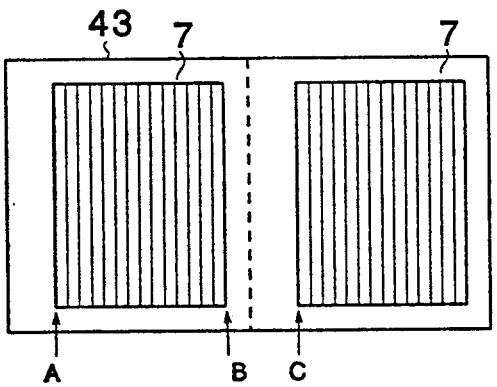

In this case, a plate making region 23*a* assigned to the stencil master plate 23 has the A3 size measuring $X' \times Y$, and a single B5 size original 7 measuring $X \times Y$ as illustrated in FIG. 5*a* was used to make a master plate and printed copies in which the images of the originals 7 are laid out laterally in two frames as illustrated in FIG. 5*c*.

First of all, an original 7 is placed on the original table 12 so as to push its leading edge between the original feed rollers 14, and the original sensor 17 detects this original 7. Then, the display device 54 indicates that the plate making operation is enabled, and the pressing of the multiple frame printing key 51 causes the display device 54 to indicate that the multiple frame printing mode is enabled, and that the machine is ready to operate.

If A3 size printing paper is either set up or being set up on the paper feed table 44, the printing paper size detecting means 47 detects its size, and this information is displayed on the display device 54. It is then determined if a process of plate making has been started (step 100), and if so it is determined if the original sensor is ON or not (step 101). If the original sensor is ON, the original feed rollers 14 are rotatively driven by the printing motor 18 to start feeding the original (step 102).

Then, it is determined whether the original IN sensor is ON or not (step 103), and if ON it is determined if the original has been fed by the distance of L mm (refer to FIG. 1) (step 104). If YES, a stencil master plate feeding step is carried out by driving the platen roller 24 and feeding the stencil master plate 23 therewith (step 105).

At the same time, the image of the original 7 is optically read by the contact type image sensor 11, and is converted into an electric signal which is then supplied to the control means 60. The stencil master plate 23 is then thermally perforated according to the image information supplied from the control means 60, and the process of making a stencil master plate is thus carried out (step 106).

Before this plate making process is started, the leading edge of the stencil master plate 23 is kept as cut off by the cutter 31 of the cutter unit 3 in the preceding plate making process.

The plate making process which is carried out according to the image information obtained from the original as described above is completed not when the plate making reading and printing step with respect to the original 7 is carried out in step 106 but when it is determined that the stencil master plate has been fed by the amount corresponding to the plate making amount data stored in the printing amount data storage means 62 according to the size of the printing paper 43 set up on the paper feed table 44 or the paper signal supplied from the printing paper size detection means 47 (step 107). If the result of this determination step is YES, the plate making process is finally concluded (step 108).

Thereafter, it is determined if the stencil master plate has been fed by the amount corresponding to the platen roller feed amount data (step 109), and, if so, feeding of the stencil master plate is ended (step 110). It is then determined if the original has been ejected (step 111), and, if so, feeding of the original is ended (step 112). This step concludes the primary process of plate making.

In the present embodiment, irrespective of the size of the printer paper 43 which is set up, the amount of plate making corresponding to a certain distance, for instance, 2 mm preceding a central line dividing the printing paper into equal parts is stored in the printing amount data storage means 62, and the amount of feeding the platen roller 24 corresponding to a certain distance, for instance, 7 mm beyond the central line 9 is stored in the printing plate making amount data storage means as the feed amount data for the platen roller 24.

Therefore, the process of plate making is started from point A in FIG. 5*c* (the position of starting the process of plate making is always fixed), and the subsequent steps of plate making is carried out by the control means 60 controlling the plate making printing driver circuit 64 according to the plate making amount data and the platen roller feed amount data stored and retrieved from the printing amount data storage means 62 for each different size data of the printing paper 43 supplied from the printing paper size detecting means 47.

In other words, without regard to whether the reading of the original has been completed or not, the process of plate making is continued up to point B slightly before the central line as indicated by FIG. 5*c*, and the original feed rollers 14 and the original ejection rollers 15 are driven until the original 7 is ejected to the ejection tray 19.

Meanwhile, the rotation of the platen roller 24 is continued to point C or the start point of the next process of plate making which is beyond point B and the central line.

Thereafter, the secondary process of plate making is carried out. First of all, the display device 54 on the operation panel 5 indicates that an original 7 is to be set up, and it is determined whether the original sensor is ON or not (step 113). If the result is YES, the original 7 is fed so that its leading edge reaches the original feed rollers 14 within a prescribed time period, for instance 17 seconds (step 114). It is then determined whether the original IN sensor is ON or not (step 115). If YES, it is determined whether the original has been fed by the distance of L mm (step 116). If YES, feeding of the stencil master plate is started in the same way as in step 105 of the primary process of plate making (step 117).

Subsequent steps 119 through 123 are carried out in the same way as steps 106 through 110 which are described above.

The stencil master plate 23 is then fed by the master plate feed roller 26 by a certain amount (step 124), and is wrapped around the drum 33 by securing an end of the master plate onto the drum 33 with the clamping unit 32 (step 125) and turning the drum 33 (step 126). When a prescribed amount of the stencil master plate 23 is wrapped around the drum 33, the stencil master plate 23 is cut off (step 127).

The stencil master plate 23 is thus wrapped around the drum 33, and the secondary process of plate making is completed to set the machine ready for the subsequent process of printing.

On the other hand, if the original sensor is not determined to be ON or is determined to be NO in step 113, it is determined whether 17 seconds has elapsed or not. If so, the program flow advances to step 124, and steps 124 through 127 are executed in the same way as described above as steps preliminary to starting the process of printing.

Now the process of printing is described in the following.

When a desired number of printed copies is entered from the ten-key pad 52, it is so indicated on the display device 54.

When the start key 50 is pressed in this condition, the printing paper 43 is supplied to the timing rollers 42 sheet by sheet by the pick up rollers 46. After a certain waiting time period, the timing rollers 42 are driven in synchronism with the angular position of the rotating drum 33, and the printing paper 43 is fed into the conveying path 41.

The printing paper 43 fed into the conveying path 41 is pressed against the outer circumferential surface of the drum 33 by the press roller 35, and the ink passed through the perforations formed in the stencil master plate 23 is deposited onto the printing paper 43 so as to form thereon the image defined by the perforations.

The printed printing paper 43 is removed from the outer circumferential surface of the drum 33 by the separation claw 55, and is ejected onto the paper ejection table 49.

Figure 5D:
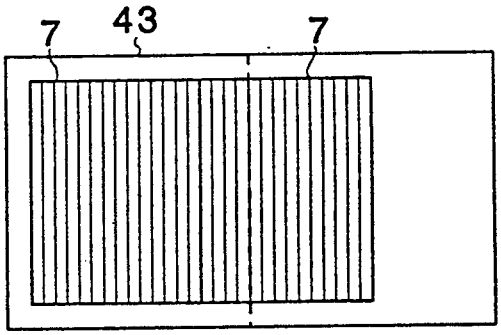

In this way, the images of the B5 sized originals 7 are laid out and duplicated onto a plurality of frames in A3 sized printing paper 43 without crossing the central line in the A3 sized printing paper as shown in FIG. 5*d*, and with the frames evenly distributed in each of the regions separated by the central line as shown in FIG. 5*c*.

In the control of repeated duplication on the same sheet of printing paper, since the region for plate making is determined according to the size of the printing paper, even when the size of the printing paper is smaller than twice the size of the original, the plate making would not be carried out beyond the size of the printing paper, and the press roller would not be smeared by printing.

In the above described embodiment, two original images were laid out on the printing paper, but the present invention is not limited to this embodiment, and can be applied to the cases where more than two original images are laid out on the printing paper. In such a case, data corresponding three, four or more frames is entered from the operation panel so that corresponding plate making data, and platen roller feed amount data may be accessed. The two original images may be either different from each other or the same depending on the purpose.

Figure 6:
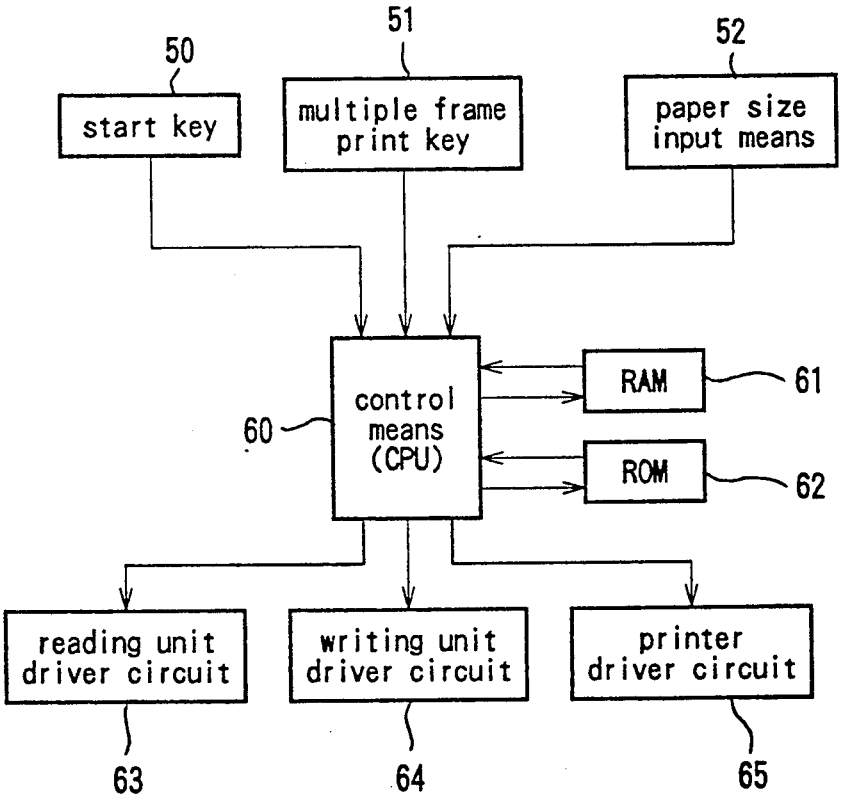
FIG. 6 is a control block diagram of a second embodiment of the stencil master plate making printing machine according to the present invention.
Figure 7:
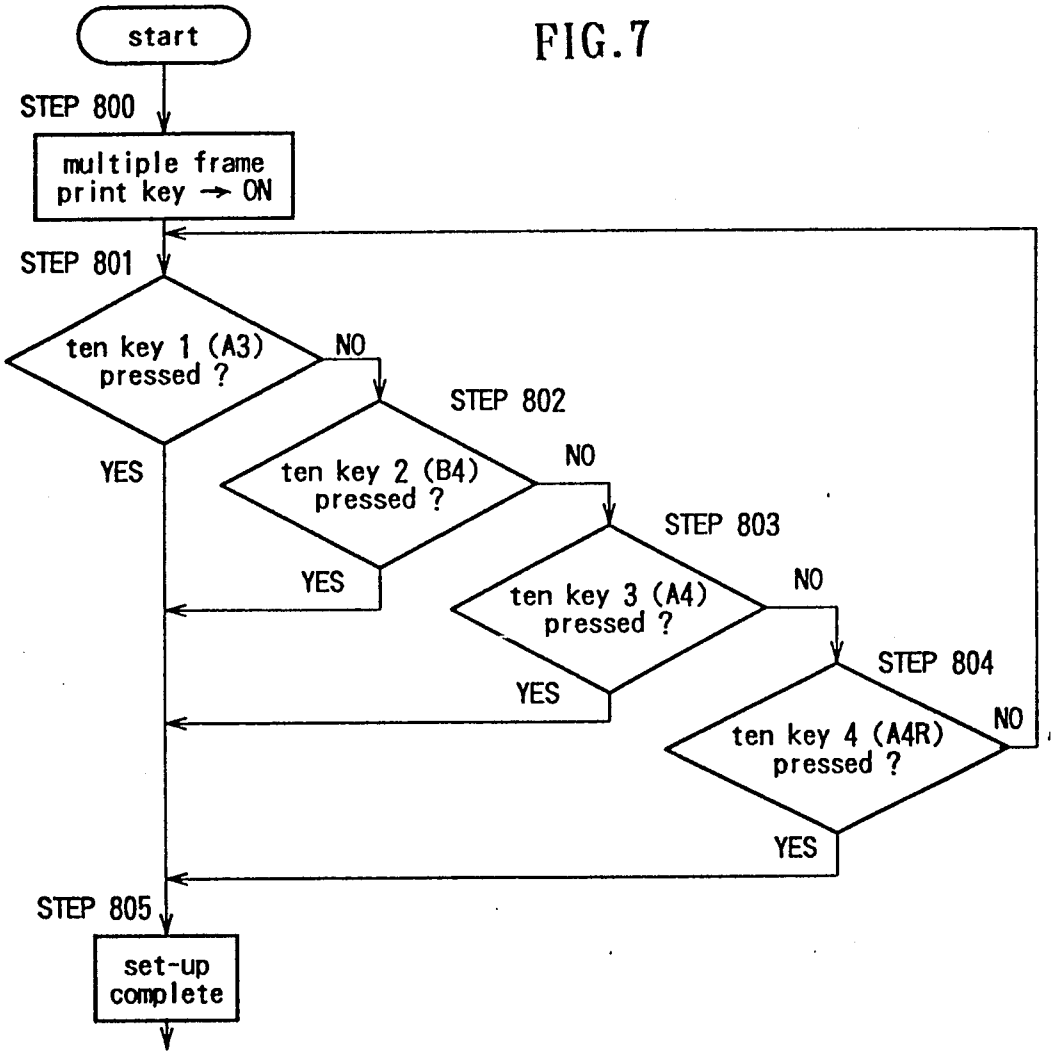
FIGS. 7 and 8 are a flow chart showing the operation of the second embodiment of the stencil master plate making printing machine shown in FIG. 6.
Figure 8:
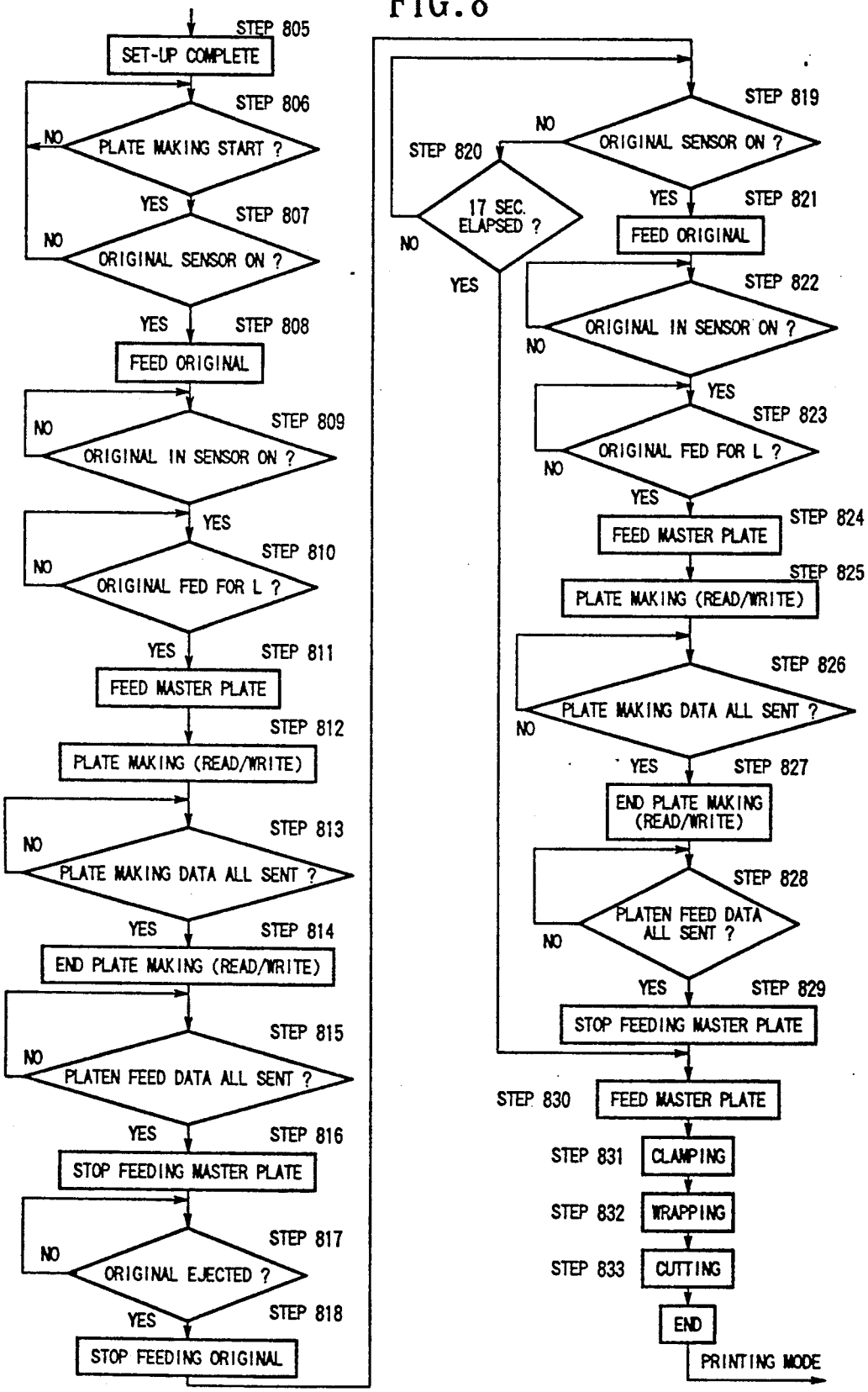

FIGS. 6 through 8 show a second embodiment of the present invention in which the size of printing paper is entered from the ten-key pad 52 instead of the printing paper size detecting means 47 provided in the paper feed table 44 of the first embodiment.

FIG. 6 shows the operating panel for the second embodiment of the stencil master plate printing machine according to the present invention, and parts corresponding to those of the previous embodiments are denoted with like numerals. This operating panel 5 similar to the operating panel of the previous embodiment except for that the ten-key pad 52 is used as means for entering the size of the printing paper as described hereinafter.

Now the operation of the second embodiment of the stencil master plate making printing machine is described in the following with reference to the flow chart given in FIGS. 7 and 8.

In this case also, a plate making region 23*a* assigned to the stencil master plate 23 has the A3 size measuring $X' \times Y$, and a single B5 size original 7 measuring $X \times Y$ as illustrated in FIG. 5*a* was used to make a master plate and printed copies in which the images of the originals 7 are laid out laterally in two frames as illustrated in FIG. 5*c*.

First of all, an original 7 is placed on the original table 7 so as to push its leading edge between the original feed rollers 14, and the original sensor 17 detects this original 7. Then, the display device 54 indicates that the plate making operation is enabled, and the pressing of the multiple frame printing key 51 causes the display device 54 to indicate that the multiple frame printing mode is enabled, and that the machine is ready to operate.

Referring to FIG. 7, when the multiple frame printing key 51 is pressed, a number of printing paper sizes assigned with different numerals are indicated on the display device 54 (step 800).

Then, by detecting which of the keys in the ten-key pad 52 is pressed, it is determined which printing paper size is selected. Specifically, it is determined if the key in the ten-key pad corresponding to A3 sized printing paper 43 is pressed (step 801), the key in the ten-key pad corresponding to B4 sized printing paper 43 is pressed (step 802), the key in the ten-key pad corresponding to A4 sized printing paper 43 is pressed (step 803), or the key in the ten-key pad corresponding to A4R sized printing paper 43 is pressed (step 804).

In this embodiment, A3 sized printing paper 43 is set up on the paper feed table, the key in the ten-key pad 52 corresponding to A3 size is pressed.

When input from the ten-key pad 52 is completed, the display device 54 indicates that the multiple frame printing mode is enabled, and the machine is ready to operate (step 805).

Referring to FIG. 8, it is then determined if the plate making start switch is ON or not (step 806), and if YES it is determined if the original sensor is ON or not (step 807). If YES, the original feed rollers 14 are rotatively driven by the printing motor 18 to start feeding the original (step 808).

Then, it is determined whether the original IN sensor is ON or not (step 809), and if ON it is determined if the original has been fed by the distance of L mm (refer to FIG. 1) (step 810). If YES, a stencil master plate feeding step is carried out by driving the platen roller 24 and feeding the stencil master plate 23 therewith (step 811).

At the same time, the image of the original 7 is optically read by the contact type image sensor 11, and is converted into an electric signal which is then supplied to the control means 60. The stencil master plate 23 is then thermally perforated according to the image information supplied from the control means 60, and the process of making a stencil master plate is thus carried out (step 812).

Before this plate making process is started, the leading edge of the stencil master plate 23 is kept as cut off by the cutter 31 of the cutter unit 3 in the preceding plate making process.

The plate making process which is carried out according to the image information obtained from the original as described above is completed not when the plate making reading and printing step with respect to the original 7 is carried out in step 812 but when it is determined that the stencil master plate has been fed by the amount corresponding to the plate making amount data stored in the printing amount data storage means 62 according to the size of the printing paper 43 set up on the paper feed table 44 or the paper signal supplied from the printing paper size input means (ten-key pad) 52 (step 813). If the result of this determination step is YES, the plate making process is finally concluded (step 814).

Thereafter, it is determined if the stencil master plate has been fed by the amount corresponding to the platen roller feed amount data (step 815), and, if so, feeding of the stencil master plate is ended (step 816). It is then determined if the original has been ejected (step 817), and, if so, feeding of the original is ended (step 818). This step concludes the primary process of plate making.

In the present embodiment, irrespective of the size of the printing paper 43 which is set up, the amount of plate making corresponding to a certain distance, for instance, 2 mm preceding a central line dividing the printing paper into equal parts is stored in the printing amount data storage means 62, and the amount of feeding the platen roller 24 corresponding to a certain distance, for instance, 7 mm beyond the central line 9 is stored in the printing plate making amount data storage means as the feed amount data for the platen roller 24.

Therefore, the process of plate making is started from point A in FIG. 5*c* (the position of starting the process of plate making is always fixed), and the subsequent steps of plate making is carried out by the control means 60 controlling the plate making printing driver circuit 64 according to the plate making amount data and the platen roller feed amount data stored and retrieved from the printing amount data storage means 62 for each different size data of the printing paper 43 entered from the printing paper size detecting means 47.

In other words, without regard to whether the reading of the original has been completed or not, the process of plate making is continued up to point B slightly before the central line as indicated by FIG. 5*c*, and the original feed rollers 14 and the original ejection rollers 15 are driven until the original 7 is ejected to the ejection tray 19.

Meanwhile, the rotation of the platen roller 24 is continued to point C or the start point of the next process of plate making which is beyond point B and the central line.

Thereafter, the secondary process of plate making is carried out. First of all, the display device 54 on the operation panel 5 indicates that an original 7 is to be set up, and it is determined whether the original sensor is ON or not (step 819). If the result is YES, the original 7 is fed so that its leading edge reaches the original feed rollers 14 within a prescribed time period, for instance 17 seconds (step 821). It is then determined whether the original IN sensor is ON or not (step 822). If YES, it is determined whether the original has been fed by L mm (step 823). If YES, feeding of the stencil master plate is started in the same way as in step 805 of the primary process of plate making (step 824).

Subsequent steps 825 through 829 are carried out in the same way as steps 812 through 816 which are described above.

The stencil master plate 23 is then fed by the master plate feed roller 26 by a certain amount (step 830), and is wrapped around the drum 33 by securing an end of the master plate onto the drum 33 with the clamping unit 32 (step 831) and turning the drum 33 (step 832). When a prescribed amount of the stencil master plate 23 is wrapped around the drum 33, the stencil master plate 23 is cut off (step 833).

The stencil master plate 23 is thus wrapped around the drum 33, and the secondary process of plate making is completed to set the machine ready for the subsequent process of printing.

On the other hand, if the original sensor is not determined to be ON or is determined to be NO in step 819, it is determined whether 17 seconds has elapsed or not (step 820). If so, the program flow advances to step 830, and steps 830 through 833 are executed in the same way as described above as steps preliminary to starting the process of printing.

In this embodiment, the means for entering data on the side of the printing paper 43 consisted of a ten-key pad 52, but it is also possible to provide a set of independent keys for entering data on the size of the printing paper 43.

As described above, according to the present invention, once the multiple frame printing set up means is so set up as to lay out a plurality of original images on the printing paper, the control means retrieves the printing data related to the formation of images in the evenly distributed regions corresponding to the detected size of the printing paper from the printing amount data storage means, and controls the printing of picture image signals at the original printing unit according to such data. Therefore, without regard to the size of the printing paper on which original picture images are to be laid out, it is possible to accommodate the picture images in evenly distributed areas in a plurality of regions of equal size defined in the printing paper.

Thus, a plurality of frames corresponding to a plurality of originals may be laid out in an agreeable manner, and it is possible to divide the printing paper into a plurality of regions each formed with different picture images so that each region may be cut off as an individual printing paper carrying an identical image. If desired, the duplication media may be each folded along the central line and bound together so that picture images may be shown on either side of each leaf.

Since the repeated duplication process according to the present invention determines the size of the regions for printing according to the size of the printing paper, even when the size of the printing paper is smaller than twice the size of the original, it is possible to avoid depositing printing ink in regions external to the printing paper.

Although the present invention has been described in terms of specific embodiments, it is possible to modify and alter details thereof without departing from the spirit of the present invention.

What we claim is:

1. A stencil master plate printing device, comprising:

multiple frame printing mode set up means for setting up a mode for writing a plurality of original images optically read by an original reading unit into different frames defined in a stencil master plate with an original image writing unit;

printing paper size detection means for detecting the size of printing paper;

writing amount data storage means for storing writing amount data for evenly distributing said frames defined in an original image printing region in said stencil master plate according to said size of said printing paper; and control means for laying out said original images obtained from said original reading unit into said original image printing region corresponding to said size of said printing paper by referring to data retrieved from said writing amount data storage means according to a detection value from said printing paper size detection means when said multiple frame printing mode is set up by said multiple frame printing mode set up means.

2. A stencil master plate making printing device according to claim 1, wherein said frames are distributed on either side of a central line of said printing paper without crossing said central line.

3. A stencil master plate printing device, comprising:

multiple frame printing mode set up means for setting up a mode for writing a plurality of original images optically read by an original reading unit into different frames defined in a stencil master plate with an original image writing unit;

printing paper size input means for inputting the size of printing paper;

writing amount data storage means for storing writing amount data for evenly distributing said frames defined in an original image printing region in said stencil master plate according to said size of said printing paper; and control means for laying out said original images obtained from said original reading unit into said original image printing region corresponding to said size of said printing paper by referring to data retrieved from said writing amount data storage means according to a value entered from said printing paper size input means when said multiple frame printing mode is set up by said multiple frame printing mode set up means.

4. A stencil master plate making printing device according to claim 3, wherein said frames are distributed on either side of a central line of said printing paper without crossing said central line.

* * * * *